US005819618A

United States Patent [19]

Rodriguez

[11] Patent Number: 5,819,618

[45] Date of Patent: Oct. 13, 1998

[54] ROTARY PAPER TRIMMER

[75] Inventor: Humberto Rodriguez, Wabash, Ind.

[73] Assignee: Martin Yale Industries, Inc., Wabash, Ind.

[21] Appl. No.: 663,604

[22] Filed: Jun. 14, 1996

Related U.S. Application Data

[63] Continuation of Ser. No. 241,158, May 10, 1994, abandoned.

[51] Int. Cl.[6] ..... B26D 1/18

[52] U.S. Cl. ..... 83/56; 83/455; 83/485; 83/489; 83/614

[58] Field of Search ..... 83/455, 485, 487, 83/488, 489, 491, 578, 614, 56, 582, 665, 698.31, 13

[56] References Cited

U.S. PATENT DOCUMENTS

| | | | |
|---|---|---|---|
| D. 317,939 | 7/1991 | Judd et al. . | |
| D. 319,840 | 9/1991 | Hatsumi et al. . | |
| D. 322,974 | 1/1992 | Mori . | |
| 502,415 | 8/1893 | Flowers | 83/485 X |
| 737,758 | 9/1903 | Miller | 83/488 X |
| 745,515 | 12/1903 | Perks | 30/292 |
| 745,516 | 12/1903 | Perks | 30/292 |
| 791,793 | 6/1905 | Johnson | 83/485 X |
| 802,720 | 10/1905 | Weber | 83/485 X |
| 821,681 | 5/1906 | Vandemark | 83/485 X |
| 884,219 | 4/1908 | Scates . | |
| 912,212 | 2/1909 | Wade . | |
| 1,075,050 | 10/1913 | Mihills | 83/489 X |
| 2,013,893 | 9/1935 | Matthews . | |
| 2,310,838 | 2/1943 | Helprin . | |
| 2,327,223 | 8/1943 | Silver . | |
| 2,746,545 | 5/1956 | Chamberlain | 83/489 |
| 2,765,037 | 10/1956 | McDonough | 83/489 |
| 3,199,109 | 8/1965 | Battaglini et al. | 83/614 X |
| 3,301,117 | 1/1967 | Spaulding . | |
| 3,447,409 | 6/1969 | Lewis | 83/485 |
| 3,463,041 | 8/1969 | Shapiro et al. . | |
| 3,513,744 | 5/1970 | Hershberger . | |
| 3,532,018 | 10/1970 | Szabo . | |
| 3,585,289 | 6/1971 | Huber . | |
| 3,628,412 | 12/1971 | Rogers, Jr. . | |
| 3,648,557 | 3/1972 | Lind | 83/489 |
| 3,766,816 | 10/1973 | Loveless | 83/489 |
| 3,788,175 | 1/1974 | Davis . | |
| 3,821,915 | 7/1974 | Larrable | 83/455 |
| 3,958,477 | 5/1976 | Carlson | 83/485 X |
| 3,996,827 | 12/1976 | Logan . | |
| 4,046,044 | 9/1977 | Paterson et al. | 83/489 |
| 4,056,027 | 11/1977 | Northrop . | |
| 4,417,495 | 11/1983 | Gordon et al. | 83/649 X |
| 4,516,452 | 5/1985 | Dahle . | |
| 4,665,787 | 5/1987 | Arnold et al. | 83/578 X |

(List continued on next page.)

FOREIGN PATENT DOCUMENTS

| | | | |
|---|---|---|---|
| 29122 | 5/1981 | European Pat. Off. | 83/485 |
| 876386 | 5/1953 | Germany | 83/485 |
| 3035787A1 | 6/1982 | Germany . | |
| 501113 | of 0000 | Italy | 83/485 |
| 1315817 | 5/1973 | United Kingdom | 83/485 |
| 2 085 792 | 9/1981 | United Kingdom . | |

OTHER PUBLICATIONS

Copy of Instruction Page of Falcon® Personal–Size Paper Cutter.

*Primary Examiner*—Maurina T. Rachuba
*Attorney, Agent, or Firm*—Brinks Hofer Gilson & Lione

[57] ABSTRACT

A rotary paper trimmer for cutting sheet material and method of using the trimmer is disclosed. The rotary paper trimmer has a base, a pressure pad, and a blade holder assembly. The pressure pad has a guide rail and a gear track attached to its upper surface. A blade holder assembly has a outer shell slidably attached to the guide rail, a shaft rotatably attached to the shell, a circular blade attached to the shell and adjacent a lateral edge of the base, and a gear attached to the shaft. As the blade holder assembly is slid on the guide rail the gear engages with the gear track and rotates the shaft and circular blade to cut sheet material inserted between the pressure pad and base.

18 Claims, 2 Drawing Sheets

U.S. PATENT DOCUMENTS

| | | | |
|---|---|---|---|
| 4,747,330 | 5/1988 | Carithers, Jr. . | |
| 4,798,112 | 1/1989 | Kozyrski et al. . | |
| 4,941,380 | 7/1990 | Lockwood . | |
| 4,967,628 | 11/1990 | Judd et al. . | |
| 4,987,812 | 1/1991 | Benavidez . | |
| 5,001,955 | 3/1991 | Fujiwara | 83/614 |
| 5,036,740 | 8/1991 | Tsai . | |
| 5,042,349 | 8/1991 | Komatsu | 83/485 X |
| 5,044,241 | 9/1991 | Labrecque . | |
| 5,069,097 | 12/1991 | Mori . | |
| 5,103,710 | 4/1992 | Ross . | |
| 5,243,890 | 9/1993 | Ober . | |
| 5,303,626 | 4/1994 | Uehara et al. | 83/485 |
| 5,322,001 | 6/1994 | Boda | 83/614 |
| 5,503,053 | 4/1996 | Onishi et al. | 83/614 X |
| 5,524,515 | 6/1996 | Boda | 83/485 X |

ROTARY PAPER TRIMMER

This application is a continuation of application Ser. No. 08/241,158, filed May 10, 1994 now abandoned.

BACKGROUND OF THE INVENTION

This invention relates to a rotary trimmer used for cutting paper or other sheet material and method of using the trimmer.

One problem with existing rotary paper trimmers is that they use many separate components that add to the manufacturing costs. Existing rotary trimmers, for example U.S. Pat. No. 4,516,452 to Dahle, have a separate guide rail with separate rail holding jaws on either side of the base of the trimmer to support the guide rail. In addition, these trimmers require a separate pressure pad to hold the sheet material to be cut.

It would be desirable to have a rotary trimmer with the guide rail formed on the upper surface of the pressure pad thus eliminating the need for holding jaws. In addition, a gear track could also be formed on the upper surface of the pressure pad to engage with a gear connected to the rotating shaft of the blade holder assembly. Moreover, it would be desirable to have an easy to assemble rotary trimmer with fewer parts designed to conveniently fit on a user's desk top.

SUMMARY OF THE INVENTION

The invention provides a rotary trimmer for cutting paper and other sheet material, and method of operating the same. The rotary trimmer comprises a rectangular base, a pressure pad, and a blade holder assembly. The pressure pad is fastened to a top surface of the base, and has a guide rail and a gear track formed on its upper surface. The blade holder assembly has an outer shell slidably attached to the guide rail, a shaft rotatably attached to the outer shell, a circular blade attached to the shaft and adjacent a lateral edge of the base, and a gear attached to the shaft for engaging with the gear track and rotating the shaft and blade as the blade holder assembly is slid along the guide rail.

The invention further provides other features including: the pressure pad, gear track and guide rail being formed as a unitary member; the blade being spring biased against the lateral edge of the base; the guide rail comprising two rails, with the gear track formed between the rails; a paper stop attached to the top surface of the base; a riser attached to the ends of the pressure pad for providing a gap between the top surface of the base and a bottom surface of the pressure pad; a stop attached at the ends of the pressure pad for preventing the blade holder assembly from disengaging from the guide rail; a riser-stop attached at the ends of the pressure pad for preventing the blade holder assembly from disengaging from the guide rail, and for providing a gap between the top surface of the base and a bottom surface of the pressure pad; a blade back-up having a blade protector portion spring biased against an outside surface of the blade, and a cylindrical portion having an opening formed in its center for receiving the shaft; the gear being attached to a blade holder having an outer portion for fitting through an opening formed in a center portion of the blade, the center portion having an opening formed in its center for receiving the cylindrical portion of the blade back-up.

The invention further provides a rotary trimmer comprising a rectangular base, a rectangular pressure pad, a pair of guide rails, a gear track, and a blade holder assembly. The rectangular base having a flat face and a lateral cutting edge. The rectangular pressure pad having longitudinal sides oriented parallel to the cutting edge and attached at each longitudinal end to the face of the base. The pair of guide rails are oriented parallel to each other and to the longitudinal sides of the pressure pad and are attached to the upper surface of the pressure pad. The gear track is oriented parallel to and between the guide rails, and is attached to the upper surface of the pressure pad. The blade holder assembly has an outer shell slidably attached to the guide rails, a shaft rotatably attached to the outer shell, a circular blade attached to the shaft and adjacent the cutting edge of the base, and a gear attached to the shaft for engaging with the gear track and rotating the shaft and blade as the blade holder assembly is slid along the guide rail.

The invention further provides the following additional features: a lateral edge of the pressure pad being aligned with the cutting edge of the base and screwably attached with a riser to the base for providing a gap between the face of the base and a bottom surface of the pressure pad; the riser having a stop portion extending upwards from the pressure pad for preventing the blade holder assembly from disengaging from the guide rails at the longitudinal ends of the pressure pad; the pressure pad, gear track, and guide rails being formed as a unitary member; the unitary member comprising a transparent material.

The invention further provides for a method of operating the rotary trimmer. Sheet material is inserted between a gap between a top face of a base and a bottom surface of a pressure pad which is attached at its ends to said base. The pressure pad has a guide rail and gear track attached to its upper surface. A blade holder assembly is slid along the guide rail. The blade holder assembly has an outer shell slidably attached to the guide rail, a shaft rotatably attached to the outer shell, a circular blade attached to the shaft and adjacent a lateral edge of the base, and a gear attached to the shaft for engaging with the gear track and rotating the shaft and blade to cut the sheet material.

The present invention, together with its attendant objectives and advantages, will be further understood with reference to the detailed description and the accompanying drawings.

DETAILED DESCRIPTION OF AN EMBODIMENT

Figure 1:
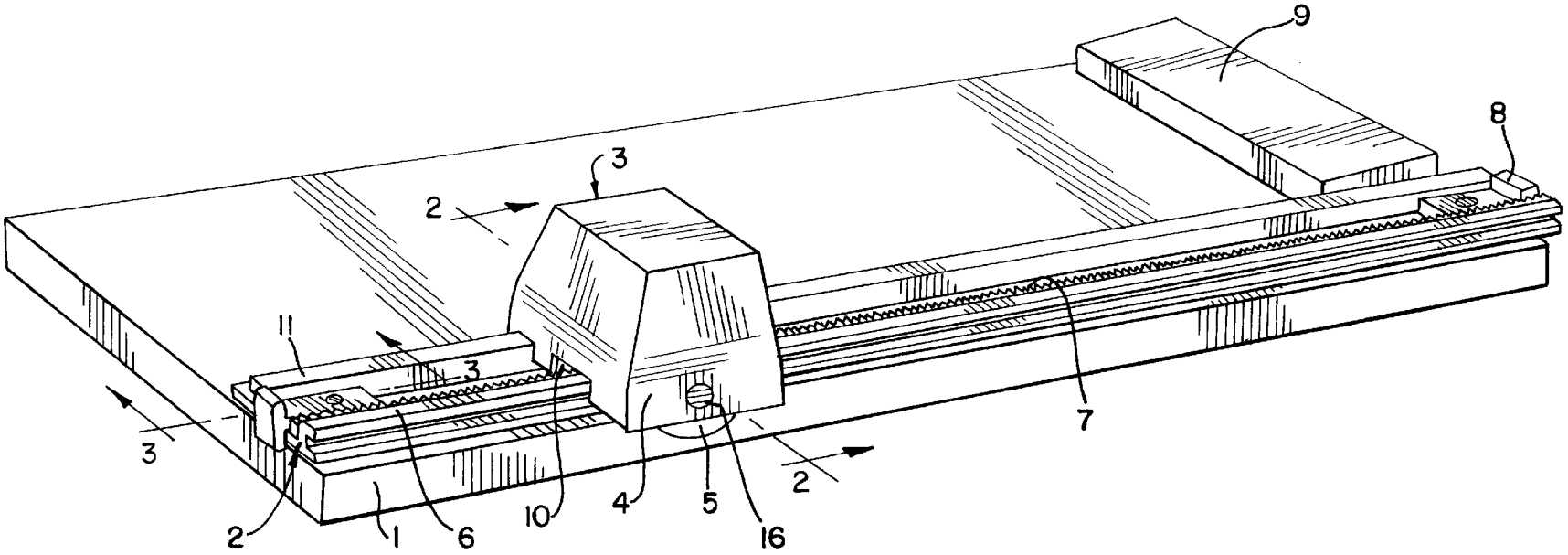
FIG. 1 is a perspective view of the rotary paper trimmer.

Referring to FIG. 1, a perspective view of the rotary paper trimmer is shown having a base 1, a pressure pad 2, and a blade holder assembly 3. The base 1 has a flat upper surface for allowing sheets of paper to be inserted beneath the pressure pad 2. The base 1 has a paper stop 9 which clips into upper face of the base 1. Graduated units of metric and/or English units (not shown) are inscribed along the top portion of the base, below the paper stop to aid the user in aligning the sheet material to be cut. The paper stop 9 is oriented perpendicular to the rectangular pressure pad 2 which is attached along one longitudinal side of the base.

The rectangular pressure pad 2 is made of a clear acrylic or Lexan and has guide rails 6, 11 and a gear track 7 formed on its upper surface. The pressure pad has a flat smooth bottom surface to allow sheet material to be slid between the holding member and the top face of the base. The pressure pad also has graduated metric or English units (not shown) inscribed on its surface to aid the user in aligning and cutting the sheet material. The pressure pad 2 is attached to the base 1 at each longitudinal end by a screw 12 which also secures a riser-stop 8 to the pressure pad and base.

Figure 3:
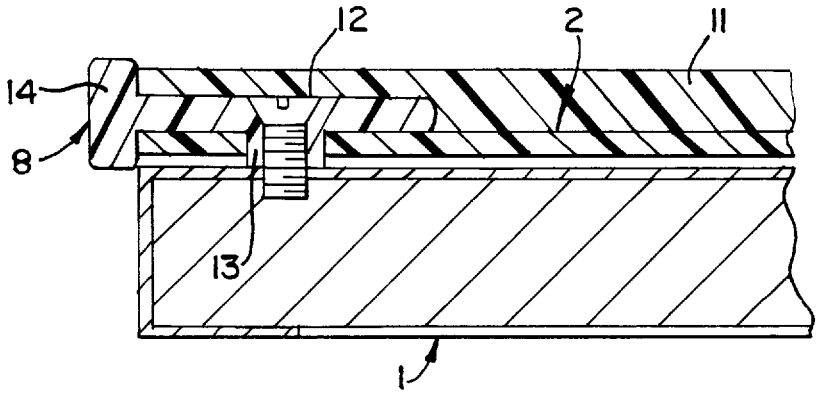
FIG. 3 is a sectional view of the rotary paper trimmer taken along line 3—3 of FIG. 1.

Referring to FIG. 3, a sectional view of the riser-stop 8, pressure pad 2 and base 1 is shown. The riser-stop 8 acts both to retain the blade holder assembly 3 on the rail and to provide a clearance between the pressure pad 2 and the base 1. The stop portion 14 of the riser-stop 8 extends approximately 0.25 inch from the top surface of the holding member 2 and contacts with a plastic outer shell 4 of the blade holder assembly 3 to prevent it from disengaging from the rails 6, 11. The riser portion 13 of the riser-stop 8 provides approximately a 0.125 inch gap between the base and the bottom surface of the pressure pad to allow sheets of paper and other material to slide beneath the pressure pad 2.

Figure 2:
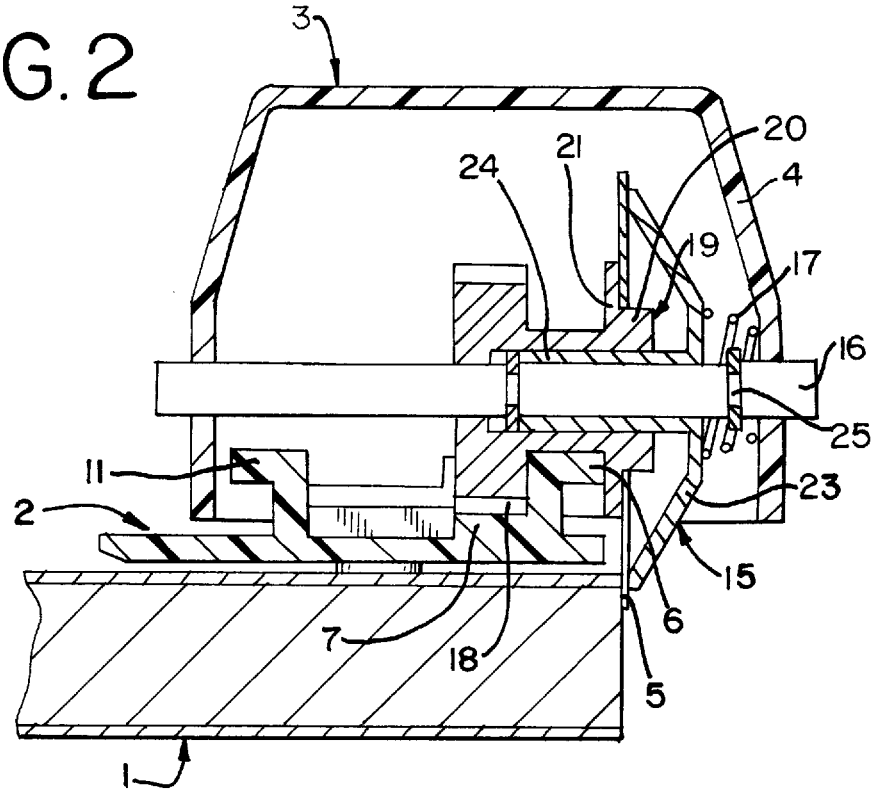
FIG. 2 is a sectional view of the rotary paper trimmer taken along line 2—2 of FIG. 1.

Referring to FIG. 2, a sectional view of the blade holder assembly 3 is shown. A shaft 16 extends through openings formed in the sides of the outer shell 4. The outer shell 4 also has openings formed therein to allow the last shell to slidably fit on to guide rails 6 and 11 formed on the upper surface of the pressure pad 2. The steel cutting blade 5 is flat and circular having a diameter of approximately 1.5 inches. The blade 5 has an opening formed in its center for receiving an outer portion 20 of a plastic blade holder 19. The plastic blade holder 19 has a inner support portion 21 adjacent the inner surface of the cutter blade 5, and a gear portion 18 for engaging with the gear track 7 formed on the upper surface of the pressure pad 2. A blade back-up 15 has a blade protector portion 23 covering all but approximately 0.12 inches of the blade 5, and a cylindrical portion 24 received within an opening formed in the blade holder. The blade protector portion 23 is biased against the blade by a compression spring 17 attached to a groove 25 formed on the shaft 16. The cylindrical portion 24 has an opening formed therein for receiving the shaft 16.

In operation, the user slides paper or other sheet material to be cut between the gap formed by the riser-stop 8 between the lower surface of the pressure pad 2 and the top surface of the base 1. The paper may then be aligned to the desired position with the aid of the straight edged paper stop 9. The user then grasps the outer shell 4 of the blade holder assembly 3 and slides the blade holder assembly on the rails 6, 11 formed on the top surface of the pressure pad 2. This action directs pressure downward from the blade holder assembly which is distributed along the length of the pressure pad 2 to prevent shifting of the paper during the cutting operation. The sliding action also engages the gear portion 18 with the gear track 7 rotating the shaft 16 and the circular blade 5. The blade holder assembly can be slid along the rails in either direction. The rotating blade is continuously biased against a lateral edge of the base by the compression spring 17 which is attached to the shaft 16 and adjacent the inner wall of the outer shell 4 and outer surface of the blade protector portion 23 of the blade back-up 15. This provides for an even cut through the paper.

While the invention has been described in reference to a certain embodiment, those skilled in the art will recognize modification of structure, arrangement, composition and the like that can be made to the present invention that will fall within the scope of the invention claimed.

I claim:

1. A rotary trimmer apparatus comprising:

a rigid base including a longitudinal side;

a flexible pressure pad for distributing downward pressure along a length of the pad and against a sheet positioned beneath the pad, the pad including an upper surface and bottom surface and first and second ends, the pad attached at the first and second ends to the longitudinal side of the base and providing clearance between the bottom surface of the pad and an upper surface of the base to allow sheet material to be inserted between the pad and base;

a guide rail formed on and extending upward from the upper surface of the pad;

a gear track attached to the upper surface of the pad;

a blade holder assembly including an outer shell, and a shaft, the outer shell slidably attached to the rail, the shaft rotatably attached to the rail;

a blade attached to the shaft; and a gear fixedly attached to the shaft and engaged with the gear track to allow a user to slide the blade holder assembly while simultaneously pressing the lower portion of the pad against sheet material positioned between the base and the pad.

2. The apparatus of claim 1 wherein the pressure pad, guide rail and gear track are formed as an integral member.

3. The apparatus of claim 1 wherein the blade is spring biased against the longitudinal side of the base.

4. The apparatus of claim 1 wherein the guide rail comprises two rails, the gear track positioned between the rails.

5. The apparatus of claim 1 further comprising a paper stop attached to a top surface of the base.

6. The apparatus of claim 1 further comprising a riser attached at the first and second ends of the pressure pad to provide the clearance between the pad and base.

7. The rotary trimmer of claim 1 further comprising a stop attached at the first and second ends of the pressure pad for preventing the blade holder assembly from disengaging from the guide rail.

8. The rotary trimmer of claim 1 further comprising a riser-stop attached at the first and second ends of the pressure pad for preventing the blade holder assembly from disengaging from the guide rail, and for providing the clearance between the upper surface of the base and the bottom surface of the pressure pad.

9. The rotary trimmer of claim 1 further comprising a blade back-up connected to the shaft and including a blade protector portion spring-biased against an outside surface of the blade, and a cylindrical portion including a center opening formed therein for receiving the shaft.

10. The rotary trimmer of claim 9 wherein the gear is attached to a blade holder having an outer portion for fitting through an opening formed in a center portion of the blade, said outer portion including a center opening formed therein for receiving the cylindrical portion of the blade back-up.

11. A rotary trimmer apparatus comprising:

a rectangular base including a flat upper surface and a longitudinal side;

a flexible rectangular pressure pad for distributing downward pressure along a length of the pad and contacting sheet material positioned beneath the pad, the pad including a longitudinal side oriented along the longitudinal side of the base, the pad including longitudinal ends that are attached to the base to leave a gap between the base and pad and allow sheet material to be inserted into the gap;

a pair of rails extending upward from the pad and oriented parallel to the longitudinal side of the base;

a gear track positioned parallel to and between the rails; and a blade holder assembly including an outer shell slidably attached to the rails, a shaft rotatably attached to the outer shell, a circular blade attached to the shaft and adjacent the cutting edge, and a gear attached to the shaft and engaged with the gear track to allow the pad to be simultaneously pressed against the sheet material as the blade holder assembly is slid along the rail.

12. The apparatus of claim 11 further comprising a riser positioned at each longitudinal end of the pad to provide the gap.

13. The apparatus of claim 11 wherein the pressure pad, gear track and rails are formed as an integral member.

14. The apparatus of claim 11 wherein the pad comprises a transparent material.

15. A method of operating a rotary trimmer comprising:

providing a flexible pressure pad including longitudinal ends, the pad attached at the ends to a base and allowing a gap between the base and pad, the pad including a longitudinally oriented guide rail and track, the blade holder assembly including a shaft, the shaft including a rotary blade attached thereto, the shaft including a gear fixedly attached thereto, the blade holder assembly slidably attached to the rail and the gear engaged with the gear track;

inserting sheet material between the gap;

sliding the blade holder assembly along the rail while the gear is engaged with the gear track, and simultaneously pressing and flexing the flexible pressure pad against the sheet material;

distributing downward pressure on the blade holder assembly along a length of the pad; and rotating the blade to cut the material.

16. A rotary trimmer apparatus comprising:

a base;

a pressure pad adapted to contact with sheet material during operation and to distribute downward pressure along a length of the pad, the pad including a first end and a second end, the pad fastened at the first and second ends to the base, the pad including a guide rail and a gear track formed on an upper portion of the pad;

a blade holder assembly including an outer shell slidably attached to the guide rail, a shaft rotatably attached to the outer shell, and a circular blade attached to the shaft and adjacent a longitudinal side of the base;

a gear fixedly attached to the shaft to engage with the gear track and rotate the shaft and blade as the blade holder assembly is slid along the rail; and a blade back-up attached to the shaft including a blade protector portion spring-biased against an outside surface of the blade and a cylindrical portion including an opening therein to receive the shaft, the gear is attached to a blade holder, the blade holder including an outer portion which fits through an opening formed in a center portion of the blade, the cylindrical portion of the blade back-up fitting through an opening formed in the outer portion of the blade holder.

17. A rotary trimmer apparatus comprising:

a base;

a pressure pad for distributing downward pressure applied by a user along a length of the pad, the pad including first and second ends, the pad attached at the first and second ends to the base, the pad including a rail extending upward from the pad;

an outer shell portion slidably attached to the rail;

a shaft rotatably connected to the outer shell;

a blade fixedly attached to the shaft;

a blade protector member spring-biased against an outside surface of the blade; and a blade holder connected to the blade and shaft.

18. A rotary trimmer comprising:

a base;

a pressure pad attached to the base, the pressure pad including at least one rail;

an outer shell portion slidably attached to the rail;

a shaft housed with the outer shell, a gear attached to the shaft and a blade attached to the shaft; and a gear track attached to the pressure pad, the gear engaged with the gear track to rotate the blade as the outer shell is slid along the rail.

* * * * *